United States Patent [19]

Bonkowski

[11] 4,281,502

[45] Aug. 4, 1981

[54] CLEAN PACK CARRIER

[76] Inventor: Lorne Bonkowski, 8302 Encino Ave., Stockton, Calif. 95209

[21] Appl. No.: 18,505

[22] Filed: Mar. 8, 1979

[51] Int. Cl.[3] ..... B65B 21/00; B65B 27/04

[52] U.S. Cl. ..... 53/398; 53/453; 53/48; 53/559

[58] Field of Search ..... 53/398, 441, 453, 464, 53/427, 487, 48, 509, 556, 559

[56] References Cited

U.S. PATENT DOCUMENTS

| | | | |
|---|---|---|---|
| 2,210,509 | 8/1940 | Strauch | 53/464 |
| 2,289,668 | 7/1942 | Mallory | 53/453 |
| 2,828,799 | 4/1958 | Harrison | 53/427 X |
| 2,874,835 | 2/1959 | Poupitch | 53/48 |
| 2,958,172 | 11/1960 | LeBranche | 53/509 X |
| 2,989,827 | 6/1961 | Groth | 53/427 |
| 3,200,944 | 8/1965 | Rapata | 206/161 |
| 3,479,789 | 11/1969 | Harrison | 53/464 X |
| 3,488,911 | 1/1970 | Poupitch | 53/441 X |
| 3,494,098 | 2/1970 | Sternau | 53/488 X |
| 3,744,626 | 7/1973 | Dreyfus | 53/398 X |
| 4,018,027 | 4/1977 | Curry | 53/48 |

FOREIGN PATENT DOCUMENTS

| | | | |
|---|---|---|---|
| 434578 | 9/1935 | United Kingdom | 53/464 |

*Primary Examiner*—John Sipos

*Attorney, Agent, or Firm*—Spensley, Horn, Jubas & Lubitz

[57] ABSTRACT

The disclosed cover, carrier and package for one or more articles, is formed from a sheet of material which is stretchable when softened but relatively rigid otherwise. In a preferred apparatus and process, such a sheet is positioned over the top of the object to be covered and the portion of the sheet directly over the object is softened. A downward force is applied to the unsoftened, still relatively rigid portion of the sheet so as to force it down and around the top of the object. This causes the softened portion of the sheet to be stretched over the top and down the side of the object, conforming closely to it and thus providing a tight seal. By covering multiple articles a carrier may be formed. Methods for controlling the thickness of different parts of the carrier are described. In addition, a carrier may be applied to both the top and bottom of an array of articles in order to form a rigid carton or case.

5 Claims, 13 Drawing Figures

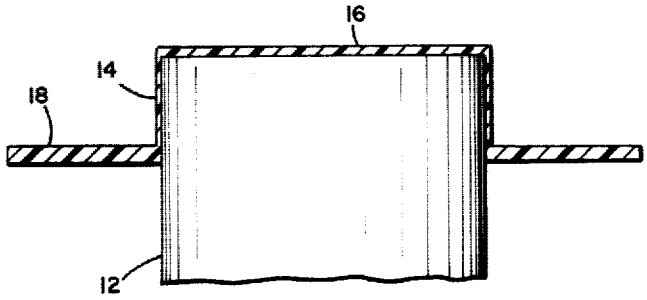
Fig. 4
Fig. 5
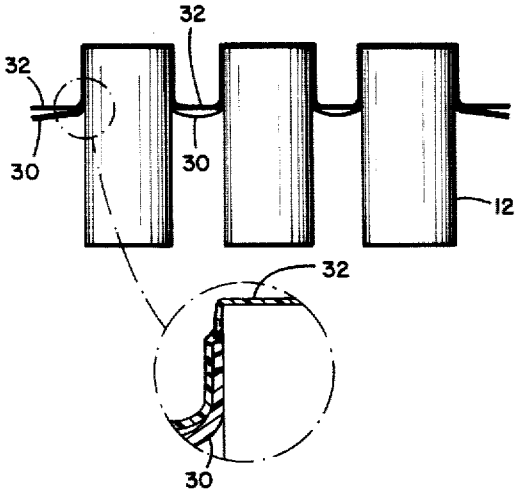
Fig. 6
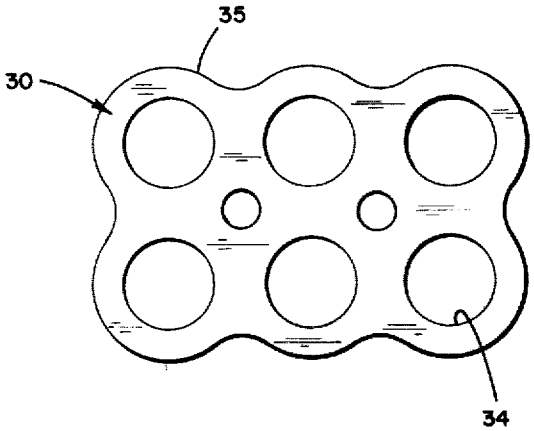
Fig. 7
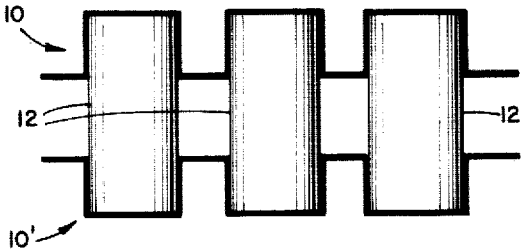
Fig. 8
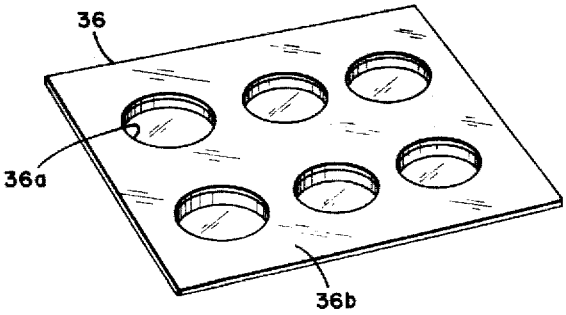

CLEAN PACK CARRIER

BACKGROUND OF THE INVENTION

1. Field of the Invention

This invention relates to the covering or packaging of one or more articles, and especially to multi-pack carriers for an array of cylindrical containers, such as the common six-pack beverage can container.

2. Prior Art

It is well known to connect an array of articles by means of a plastic carrier in order to package them as a single unit. There are many packages of this general type, representative carriers and packaging machines being disclosed by Poupitch in U.S. Pat. Nos. 2,874,835, 2,929,181 and 2,936,070, by Hall et al. in U.S. Pat. No. 3,032,944, by Fisher in U.S. Pat. No. 3,044,230, by Dreyfus in U.S. Pat. No. 3,744,626, and by Curry et al. in U.S. Pat. Nos. 3,134,485 and 3,206,019. In addition, carriers which incorporate a cover of some type over the containers are disclosed by Harrison in U.S. Pat. No. 3,046,711, by Rapata in U.S. Pat. No. 3,200,944, by Poupitch in U.S. Pat. No. 3,355,013, by Hatfield in U.S. Pat. No. 3,871,699, and by Curry et al. in U.S. Pat. No. 4,116,331. Most of these carriers include either a first carrier layer and a second cover layer, or require the presence of a bead on the rims of the containers, or both.

It is an object of the present invention to provide a simple one-piece closely fitting cover for an article. It is another object of the present invention to provide a carrier which does not require a bead or ridge of any type on the rim of the article in order to securely hold the container, permitting the carrier to be used with a wide variety of container types and styles. It is a further object of the present invention to provide a carrier which may be conveniently applied to both the top and bottom of an array of articles so as to form a rigid case. It is a further object of the present invention to provide a carrier which includes a cover to protect and keep clean the tops of the carried articles. It is another object of the present invention to provide a machine and method for making such a carrier and for controlling the thickness of different parts of the carrier. It is a further object of the present invention to provide a simple two-piece carrier having a cover layer and a carrier layer.

SUMMARY OF THE INVENTION

These and other objects are accomplished using a sheet of material which is stretchable upon softening but otherwise relatively rigid. To form a carrier, a sheet of such material is placed adjacent (such as over) one or more of the articles to be covered or interconnected. The portion of the sheet which is directly over the top of each article is selectively softened by the application of heat or some other appropriate means. The unsoftened portion of the sheet is then forced down over the top of each article. This causes the softened portion of the sheet to be stretched over the top of each article and down tightly against its side to conform closely thereto. The softened portion of the sheet then is allowed to return to its unsoftened relatively rigid state, resulting in a carrier that both covers the top of each article and grips the sides of each article, thereby forming an effective cover and carrier.

Various methods may be employed to control the thickness of different portions of the formed carrier. In the case where heat is used to soften the sheet, both the location and amount of heat applied to the sheet may be varied in order to control the ultimate thickness of different parts of the carrier. In addition, the speed at which the unsoftened portion of the sheet is forced over the article or article also may be varied to control the thickness of different parts of the carrier.

The carrier of the present invention also may be formed by using two sheets of stretchable material rather than one. One of the sheets may be relatively thin and serve as a cover sheet; The other, carrier sheet should be relatively thick. It may include openings for the articles if desired. The thicker sheet provides the strength required to hold the interconnected articles together, especially during handling. Both sheets are placed over the array of articles to be interconnected and the portion of the thin sheet over the tops of the articles is softened. In addition, the portion of the thick sheet over at least each container rim also is softened at the same time. The unsoftened portions of both sheets then are forced down around the tops of the articles. This stretches the softened portion of the two sheets over and around the tops of the articles. The heat and pressure also may fuse or partly fuse softened portions of both sheets together. The thin sheet may be on top of, or underneath, the thicker sheet.

A pair of such carriers may be used to form a rigid case for an array of articles. This is accomplished by forming a carrier both over the tops and bottoms of the array of articles. This prevents the normal jiggling motion which occurs due to the flexibility of the sheet material of the carrier when only one carrier is used, and also holds the articles in a fixed position relative to one another.

BRIEF DESCRIPTION OF THE DRAWINGS

The invention will be further described in connection with the accompanying drawings in which:

FIG. 4 is a plan view of a container with a sheet covering it, illustrating in one embodiment the thickness of different parts of the cover sheet;

FIG. 5 is a plan view of an array of cans showing a two-piece carrier interconnecting the array;

FIG. 6 is a top plan view of one of the sheets which may be used in a two-piece carrier;

FIG. 7 shows an array of containers connected by means of two carriers to form a rigid case or carton;

FIG. 8 shows a variation in the sheet which is used to make the carrier;

DESCRIPTION OF THE PREFERRED EMBODIMENTS

As will be apparent to those skilled in this art from the teachings herein set forth, the disclosed carrier may take any of numerous forms. In its simplest form, it may be used simply to cover, seal, hold or protect a single article. In a more complex embodiment, it may interconnect a series of articles. In a still more complex arrangement, it may be used not only to interconnect articles, but also to envelope the outer surfaces of the array and thereby to form a protective case. Any version of the carrier may be formed in any of various ways using different machines and processes. The embodiments of the carrier herein set forth, therefore, are merely illustrative of the invention and the principles it employs. While it is described in many of the embodiments as being applied to a series of containers, such as beverage containers, it of course may be applied to any of a wide variety of other articles.

Figure 1:
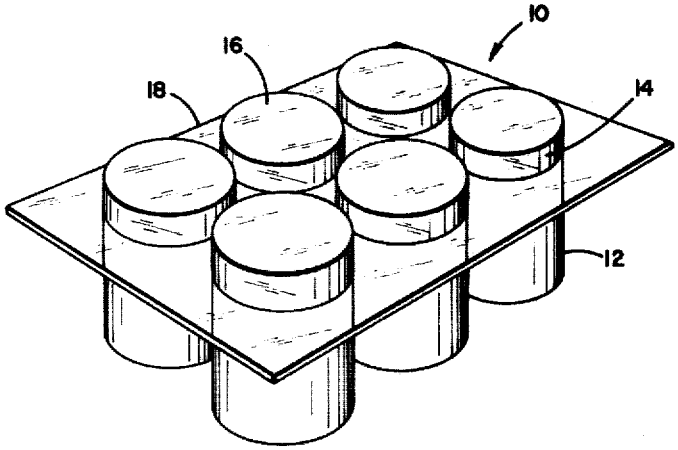
FIG. 1 is a perspective view of an array of containers interconnected by a carrier formed in accordance with the present invention.

Referring to FIG. 1, a carrier 10 is shown interconnecting an array of six containers 12. The carrier 10 includes a side portion 14 which surrounds the upper part of the wall of each container 12 in the array. A cover portion 16 is located over the top of each container. A skirt portion 18 extends from the bottom of the side portions 14, the common skirt portions interconnecting the containers 12.

The containers 12 shown in FIG. 1 do not have beads on their rims; the carrier of the invention will work satisfactorily on containers with or without beads. Furthermore, although the following description generally contemplates a carrier for containers, the invention is not so limited. In general, any object which requires a protective covering over one or more ends (such as a hermetically sealed jar), isolation from another item for purposes such as shipping (e.g., light bulbs), or is conveniently packaged, shipped, or sold as multiples (such as typical beverage containers) may employ the carrier of the present invention. In addition, the carrier 10 may be employed singly to provide a protective or supportive covering for a single article, such as required to hold one or more articles to a typical display card; i.e., it need not be used to interconnect a plurality of articles.

Figure 2:
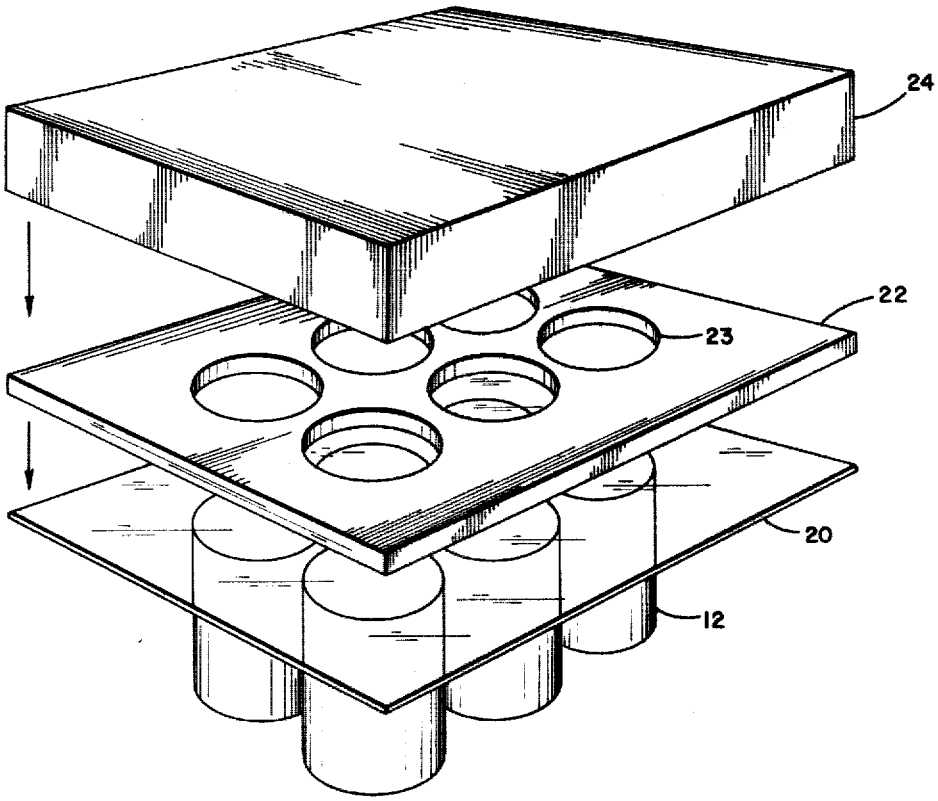
FIG. 2 is a perspective view of an array of containers showing a carrier sheet positioned above the containers, an insulating plate positioned above the carrier sheet, and a heater located over the insulating plate.

Referring now to FIGS. 2, 3A, 3B, and 3C, the method of making the carrier 10 will be described. As shown in FIG. 2, a sheet of material 20 which is used to form the carrier 10 is positioned over the array of containers 12 which are to be interconnected. Of course, the sheet alternatively may be positioned under, or otherwise adjacent, the array. This arrangement is simply illustrative of the invention.

The material which is used for the sheet 20 is one which initially is relatively rigid, but which may be softened and stretched, then when returned to its unsoftened state generally will solidify and remain in its stretched configuration. Many materials are suitable. For example, thermoplastic materials, such as poylvinyl chloride, polyethylene, and polypropylene may be used. In addition, materials which may be selectively softened and rendered stretchable chemically or in other ways also would be suitable.

Figure 3A:
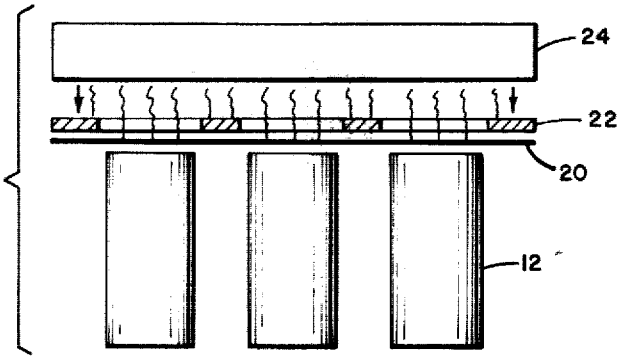
FIGS. 3A, 3B and 3C are plan views of an array of containers showing a sequence of the steps which may be employed in the formation of a package using the carrier.
Figure 3B:
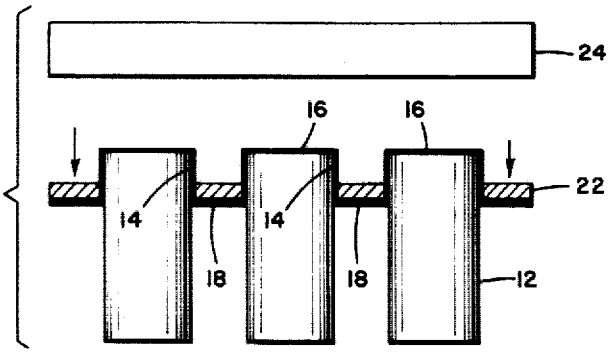

Located above the sheet 20 is an insulating plate 22. The plate 22 includes an opening 23 above each container 12 which corresponds in shape to, and is slightly larger than, the top of the container 12. A heater 24 is located above the insulating plate 22. In operation, the insulating plate 22 is placed on top of the sheet 20 and exposes the portion of the sheet 20 which is directly above the tops of the containe.. 12. The heater 24 is then turned on and heats the exposed portion of the sheet 20, as shown in FIG. 3A, until it softens. The insulating plate 22 prevents the remaining portion of the sheet 20 from being softened. When the exposed portion of the sheet 20 has been softened to the proper extent, the insulating plate 22 is lowered over the containers 12 (or the containers 12 may be raised) so that each opening 23 in the insulating plate 22 surrounds its corresponding container 12. The pressure of the insulating plate 22 on the unsoftened portion of the sheet 20 causes the softened portion of the sheet 20 to be drawn tightly over the tops and stretched around the side of each container 12. Thus, the containers 12 act as mandrels around which the softened sheet 20 is drawn and conformed.

Figure 3C:
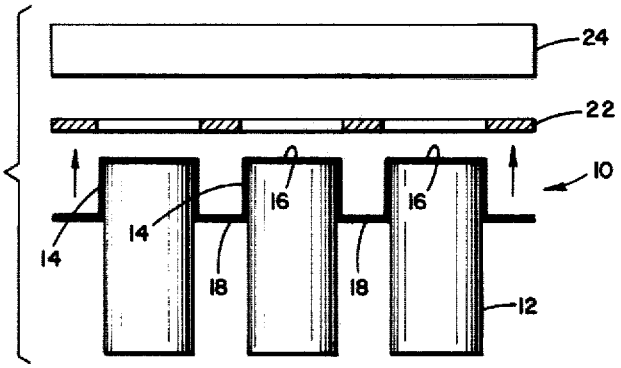

Depending upon the material used for the sheet 20, the continued application of heat during all or part of the pressing step may or may not be required. After the sheet 20 has been conformed around the containers 12, the insulating plate 22 is removed, as shown in FIG. 3C. Since heat is no longer being applied, the sheet 20 hardens and remains in the desired shape and location over the containers 12. The sheet material may tend to contract slightly during hardening. Being closely conformed about the containers 12, however, it tightly grips the top portion of the containers. When the sheet 20 returns to its original unsoftened state, the process is completed and an effective one piece carrier and cover is provided in a simple, effective, economical manner.

As has been noted, the carrier holds the articles it receives, not necessarily by interlocking some element of each article, such as a bead or screw threads or other protrusions about the upper rim of the article, but rather by conforming closely about the upper portion of each article. Thus, by applying the sheet to a greater or lesser extent about the upper portion of each article, the force by which the carrier holds each article may be adjusted, and the force applied to dislodge or remove each article from the carrier may be varied to achieve a secure package, yet one in which each article may be removed without appreciable difficulty.

As a specific example of the manner in which a carrier may be formed about an array of articles, a sheet of ten mil (0.010 inches) linear high-density polyethelyne was used to package an array of six beverage containers. The sheet was heated by holding the face of a typical nichrome ribbon household-type heater, approximately one inch from the sheet. The insulating plate-an aluminum plate about ¼ inch thick which was initially at room temperature-was positioned between the heater and the sheet to only allow the areas over the containers to be heated, all as just described. Heat was applied for approximately 10 to 12 seconds, then the heat was removed and the insulating plate was immediately depressed to force the sheet down about the upper portions of the array of containers approximately 1 to 1½ inches, thereby forming the carrier.

In the preceding example, and in examples which follow, an insulating plate is employed to shield areas of the carrier which are not to be heated. Alternatively, the entire carrier could be heated and, just prior its application to the array of articles to be packaged, a cold surface could be applied to cool and render relatively rigid the areas of the sheet which are not to conform about the upper portions of the articles. Again, these examples are simply illustrative of the invention.

Virtually innumerable variations may be employed to achieve the disclosed carrier. The particular technique employed probably depends for the most part upon the preferences of the user.

Referring now to FIG. 4, since the softened material is stretched so as to cover the top and a portion of the side of each container 12, the carrier 10 usually will not have a uniform thickness. The unsoftened portion (i.e., the skirt 18) of the sheet 20 normally retains its original thickness, while the stretched portion of the sheet (i.e., the side portions 14 and cover portions 16) will vary in thickness depending upon the extent to which the sheet has been stretched. By controlling the parameters of the forming process, including heat, speed and pressurized area, the ultimate thickness of different parts of the carrier 10 may be controlled. For example, it may be desired to produce a carrier having a cover portion 16 which is very slightly stretched and therefore relatively thick, and a side portion 14 which is greatly stretched and therefore quite thin. The factors which control the extent of stretching, and therefore the ultimate thickness of different portions of the carrier, include the extent to which the sheet 20 is softened (i.e., the amount of heat which is applied), the location of the heat which is applied to the sheet 20 (i.e., different amounts of heat may be applied to different parts of the exposed portion of the sheet 20 so as to soften them to a different extent), the area of the sheet to which pressure is applied, and the speed at which the insulating plate 22 is lowered about the containers 12. By controlling these factors, it is possible to produce a carrier wherein both the sides 14 and cover 16 portion have a uniform thickness, or one in which thickness of the sides 14 is greater than that of the cover 16, or a carrier wherein the thickness of the cover 16 is greater than that of the sides 14. In addition, it may be desirable to make the portion of the carrier 10 which covers the rim of each container 12 (i.e., the intersection of the cover portion with the side portion) thicker than either the side or cover portions 14 and 16 so as to withstand the abrasion and nicks which normally occur at that point. To achieve such a configuration, the annular area of the sheet which will overly the rim is heated less than the adjacent areas, or not at all. In short, by adjusting the factors mentioned, any of these configurations may be achieved.

Referring now to FIG. 5, a carrier may be formed from multiple layers of sheet material 20, rather than just one. This may be desirable when, for example, a very thin cover portion 16 is satisfactory but a thicker skirt portion 18 is required to properly support the containers 12. In such a case, a relatively thick sheet 30 is used with a very thin sheet 32 in order to form a carrier. During their application to the articles, these sheets may tend to fuse or weld together.

As shown in FIG. 6, the sheet 30 may include a plurality of openings 34 which receive the tops of the containers 12. The openings 34 are somewhat smaller than the openings in the insulating plate 22. Therefore, a portion of the sheet 30 will be exposed to the heater 24 through the openings 23 in the insulating plate 22 to be inserted and softened with the overlying area of the thinner sheet 32. Often the outer margin 35 of the carrier will be configured as shown in FIG. 1 to closely approximate the outer surfaces of the packaged articles.

To form a two-layer carrier, the two sheets 30 and 32 may be placed one on top of the other in either order. The carrier is then located and applied to the articles in the same manner as is a single layer carrier. Since portions of both sheets 30 and 32 are exposed to the heater 24 through the openings 23 in the insulating plate 22, they will both be softened by the heat. Therefore, when the insulating plate 22 is pressed down, the softened portions of the sheets 30 and 32 will tend to be fused or welded together, as suggested in the detail of FIG. 5. Due to this fusing action, it is unimportant which of the layers 30 or 32 is on the top. However, since both sheets will closely conform to the article, such fusing is not required to achieve a secure useable, durable carrier which also covers the articles.

Referring now to FIG. 7, a carrier (either single or double layer) may be placed on both the top and the bottom of the array of containers 12 in order to form a rigid case. Due to the flexibility of the skirt portion of the carrier, the containers 12, although held securely by a single carrier, are not held by a single carrier in a fixed position with respect to one another along their entire height. The addition of a carrier 10 about the bottoms of the containers 12 serves to hold each container in a relatively fixed and rigid position with respect to all of the other containers. The sides of the two carriers may be extended to meet, or folded to meet, in the center of the containers if desired, thereby completely enclosing the containers to seal and protect the entire array.

As an alternative to the use of the insulating plate 22 to soften portions of the sheet which is used to form a carrier, a sheet 36 as illustrated in FIG. 8 may be used. The portions **36*a* of the sheet 36 which are desired to be softened are thinner than the remaining skirt portion 36*b* of the sheet 36. This allows the sheet 36 to be heated uniformly, but only to an extent which softens the thinner portion 36*a* of the sheet 36. The relatively unsoftened portion 36*b*** may then be forced downward about an array of containers to form a carrier in a normal fashion.

Figure 9:
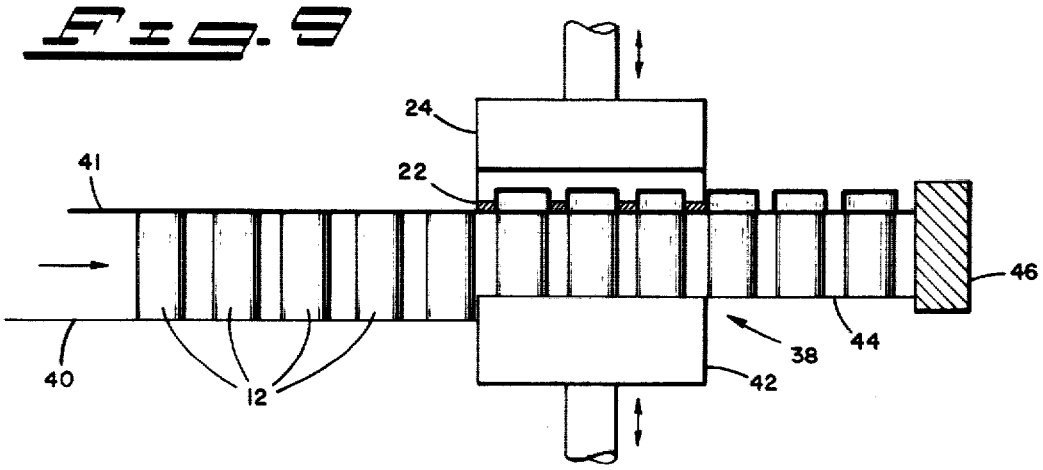
FIG. 9 is a plan view of a machine which may be used to make the carrier.

Referring now to FIG. 9, one embodiment of a machine for forming a carrier is shown. Initially containers 12 are moved into a forming station 38 by means of an intermittent conveyor 40. A continuous plastic sheet 41 which is used to form the carrier is situated on top of the containers 12. When the containers 12 and the plastic sheet 41 reach the forming station, the insulating plate 22 and heat source 24 are moved from an "up" position to a "down" position. Heat is then applied to the exposed area of the sheet 41 until it softens. At that time, a pressure ram 42 is activated to push the containers up through the openings in the insulating plate 22, thereby stretching the softened portion of the sheet 41 about the upper portions of the containers. FIG. 9 shows the heater 24 and insulating plate 22 in their "down" position, and the pressure ram 42 in its "up" position. As the stretched and softened portion of the sheet 41 cools it contracts slightly to firmly grip the containers 12. At this point, the pressure ram 42 is lowered to its original position. Since the containers 12 are now held tightly by the conformed sheet 41, they will not lower with the pressure ram 42. After the pressure ram 42 is completely lowered, insulating plate 22 and heat source 24 are moved to an "up" position. Then a take out conveyor 44 and the conveyor 40 are activated, moving the carrier from the forming station and bringing the next set of containers into position in the forming station 38. The interconnected carrier with its array of containers is cut from the sheet 41 by means of a cut-off unit 46. It should be noted that, in the machine described, the carrier itself is formed by forcing the containers through the openings in the insulating plate 22 rather than lowering the insulating plate 22 over the containers. All that is required is relative motion between the insulating plate 22 and the containers 12 sufficient to apply the softened material about the tops of the containers 12.

Figure 10:
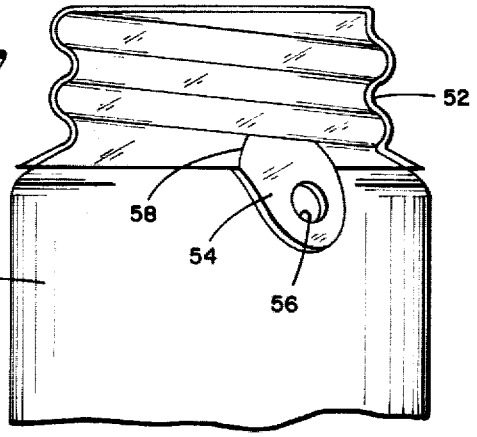
FIG. 10 is a perspective view of an upper portion of a container about which has been applied a carrier.

In the preceding examples, the carrier has been employed to hold an array of articles which have been illustrated as being rimless. Of course, neither of these features are inherent limitations of the invention. Shown in FIG. 10 is an example of the carrier applied about a single article 50, one with a screw top. The carrier 52 is applied generally about the container in the manner previously described, the portion overlying the screw thread, upon cooling, tending to closely conform to the screw threads, as illustrated, thereby to hermetically seal the container if the material employed for the carrier is relatively impervious to gas and vapor passage. The carrier may include an outstanding tab 54 that has an opening 56 by which it may be hung upon a display rack. Also, by including one or more weakened areas 58 adjacent the tab, by lifting the tab the user may easily tear the carrier 52 from the top of the container to open it. Because the carrier 52 may be made of relatively thin material, if desired, a cap (not shown) may be threaded over the top of the container in a normal fashion.

One important feature of this example, a feature not clearly illustrated in the preceding examples, is that the carrier tends to conform closely about even indentations or other irregularities in the side of the container over which it is applied. Thus, if the carrier is used to hold articles having an indented bead and shoulder area about their top rims, the carrier tends to conform to such irregularities. However, the carrier does not depend upon such irregularities to securely hold the packaged articles. Instead, it appears to depend mainly upon a frictional grip of the side of each article received in the carrier to hold such received article. As has been noted, by varying the extent to which the carrier is applied about each article, this grip may be adjusted and controlled in a simple fashion to achieve the desired holding force.

Figure 11:
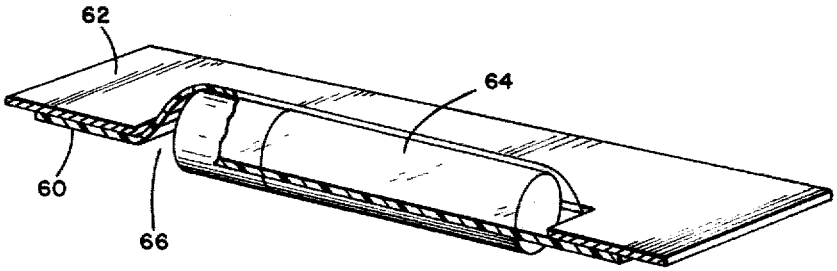
FIG. 11 is a perspective view, partially in section, of a single article about which a carrier and a card have been applied.

As an example of the versatility of the disclosed carrier and invention, shown in FIG. 11 is the carrier applied about another article, a cylindrical object. The carrier 60 may be received in this embodiment beneath a relatively rigid cardboard sheet 62 that may bear identifying and advertising information. The carrier 60 may be heated and applied about article 64 as previously described, the article being forced into the carrier beyond its mid-point so that the side of the carrier envelopes more than half of the circumference of the article, such envelopement holding the article within the carrier and to card 62. By varying the extent to which the carrier is forced down about the article, and underlies it, this holding force also may be varied. Further, the carrier may incorporate a recession 66 adjacent one end of the article (or two such recessions adjacent opposed sides of the article) permitting the purchaser to insert a finger into the recession 66 and easily remove the received article from the carrier. Of course, more than one such article may be received in the carrier. Also, as this example illustrates, the article received in and packaged by the carrier may have virtually any shape, including a rectangular, polygonal, oval or irregular shape. Again, the invention does not require articles of a particular shape or configuration; it may be employed to package articles of virtually any shape.

It is important to note that the carrier of the present invention is formed by applyi[illegible] selectively softened sheet to one or more articles. In particular, only the portion of the sheet intended to overlie and receive the article or articles to be packaged is softened. From various experiments, it appears that if appreciably more than this area of the sheet is softened, a close conformity of the sheet will not be achieved about the article or articles. Thus, they will not be securely held. Further, while the sheet is illustrated in various examples as being softened while adjacent the articles, of course the sheet may be softened while elsewhere and then brought to and applied about the articles. In addition, while the sheet has been shown as being relatively free from the insulating plate, particularly when small sheets are being applied about single articles, such as shown in FIG. 11, it may be desirable to reinforce the outer rim of the sheet so that as heat is applied to an area of the plastic the other portions of the plastic do not droop to also receive heat and be softened. In the example shown in FIG. 11, this may be achieved by adhering the sheet to the overlying card. Alternatively, an underlying support may be employed to hold the sheet in position, thereby preventing the heat from causing the sheet to droop and a greater area of the sheet to be heated than was originally intended. Another way to achieve this is to reverse the relative position of the article, sheet, plate and heater. The heat being applied from underneath the plate to an overlying sheet, the article being positioned above the sheet. Thus, the force of gravity which otherwise would have tended to cause the sheet to droop upon being heated now will only cause the sheet to rest upon the insulating plate, thereby insuring that only the portion of the sheet intended to be heated will, in fact, be heated.

In summary, the present invention provides a carrier and cover for one or more containers or similar articles. The carrier works equally well on containers having smooth or contoured sides. It is formed by selectively softening a portion of a sheet of relatively rigid material sufficiently to render it pliable, then stretching the softened portion over the articles. The stretched material, upon cooling, grips the side portions of each article and provides a cover for its top. While preferred embodiments of the invention have been described, other variations will undoubtedly occur to those skilled in the art. Accordingly, the scope of the invention is defined by the following claims.

What is claimed is:

1. A method of forming a carrier for at least one article, said at least one article having a top surface and a sidewall surface comprising the steps of:

positioning a sheet of material which is stretchable when softened but otherwise relatively rigid adjacent the top surfaces of said at least one article;

softening only the portion of said sheet corresponding to said top surface, leaving a non-softened portion of said sheet around said softened portion;

forcing the non-softened portion of said sheet around said sidewall surface sufficiently to cause the softened portion of the sheet to stretch and conform about said top surface and a portion of said sidewall surface of said at least one article thereby forming a closely fitting carrier;

said sheet being made of a thermosensitive plastic, said sheet being positioned adjacent said top surface;

said softening step including a step of heating a portion of said sheet which is to be located adjacent said top surface;

said softening step further including the step of positioning an insulating plate over said sheet prior to said heating step, said insulating plate including an opening corresponding to each said top surface that exposes said portion of said sheet that comprises an area slightly larger than said top surface, and heating each said portion of the sheet which is exposed through an opening in said insulating plate; and said forcing step including the step of moving said insulating plate towards and about each said top surface, thereby forcing the unheated portion of said sheet about said sidewall surface and drawing the heated and softened portion of the sheet about said top and sidewall surfaces to cover said top surface and grip said sidewall, the plate being moved sufficiently about said sidewall that the sheet firmly grips said sidewall to securely lock it to the sheet.

2. A machine for forming a carrier for at least one article, said at least one article having a top surface and a sidewall surface, wherein said carrier is formed from a sheet of material which is stretchable upon being softened by the application of heat but which is otherwise relatively rigid, comprising:

means for moving said sheet to a position adjacent the plane defined by said top surface;

means for softening only the portion of said sheet corresponding to said top surface, leaving a non-softened portion of said sheet around said softened portion, said softening means including a source of heat, an insulating plate between said source of heat and said sheet, said insulating plate including an opening corresponding to each said top surface, and means for causing the source of heat to soften the portions of said sheet which are exposed by said openings, and means including said insulating plate for forcing the non-softened portion of said sheet down about each said sidewall surface, thereby causing said softened portion to stretch and be drawn over and about said top surface and a portion of said sidewall surface of said at least one article to form a closely fitting carrier wherein said means operates by moving said plate relative said at least one article so that said plate forces the non-softened portion of said sheet down about each said sidewall surface.

3. The method of claim 1 wherein said softening step includes the step of softening different parts of the portion of said sheet which is located adjacent said top surface to different degrees, thereby controlling the thickness of different areas of said carrier after it is applied to said surfaces.

4. The method of claim 1, further including the step of controlling the speed at which the non-softened portion of said sheet is forced about the sidewalls, thereby controlling the thickness of different parts of said carrier after it is applied.

5. The method of claim 1 further including the steps of:

positioning a second sheet of stretchable material adjacent to the first sheet of stretchable material, said second sheet of material having an opening corresponding to each said top surface;

softening the marginal area about each opening in the second sheet simultaneously with the softening of the portion of said first sheet; and forcing the softened portion of said second sheet about said sidewall surfaces to cause the marginal areas to lie about said sidewalls simultaneously with said forcing step while maintaining the unsoftened portion of each sheet adjacent to one another.

* * * * *